United States Patent [19]

Jones

[11] Patent Number: 4,852,849

[45] Date of Patent: Aug. 1, 1989

[54] LIFTING SEATS

[76] Inventor: Eifion R. Jones, 18 Bryn Helyg, Penmaenmawr, Gwynedd, United Kingdom

[21] Appl. No.: 157,380

[22] Filed: Feb. 17, 1988

[51] Int. Cl.[4] ..... A47C 3/03

[52] U.S. Cl. ..... 248/575; 297/DIG. 10; 248/561

[58] Field of Search ..... 248/575, 421, 561, 574, 248/578; 297/DIG. 10, 301, 304; 4/251

[56] References Cited

U.S. PATENT DOCUMENTS

| | | | |
|---|---|---|---|
| 82,992 | 10/1868 | Rich | 248/578 X |
| 974,769 | 11/1910 | Hoff | 297/DIG. 10 X |
| 2,164,116 | 6/1939 | Lincoln | 4/251 |
| 4,573,736 | 3/1986 | Levenberg | 297/DIG. 10 X |
| 4,690,457 | 9/1987 | Poncy et al. | 297/DIG. 10 X |

FOREIGN PATENT DOCUMENTS

| | | | |
|---|---|---|---|
| 494034 | 1/1978 | Australia | 297/DIG. 10 |
| 8204249 | 6/1984 | Netherlands | 297/DIG. 10 |
| 1277210 | 6/1972 | United Kingdom | 297/DIG. 10 |
| 1500361 | 2/1978 | United Kingdom | 297/DIG. 10 |

*Primary Examiner*—Ramon S. Britts
*Assistant Examiner*—Karen J. Chotkowski
*Attorney, Agent, or Firm*—Anthony J. Casella; Gerald E. Hespos

[57] ABSTRACT

A lifting seat device having a lifting arm coupled to or adapted to be coupled to a seat member and a mechanism for controlling the angular position of the lifting arm to assist in lowering and raising the seat member, the lowering and raising mechanism comprising a compression spring enclosed within a housing and whose compression is arranged to be increased upon the lifting arm being angularly displaced as a result of a user sitting on said seat member, there being means enabling the spring to be adjustably pre-stressed to enable the load/-displacement characteristics of the lifting arm to be adjusted and preselected. The lifting arm can be selectively separable from the lowering and raising mechanism so that when the lifting arm is removed from or is repositioned in the mechanism, the seat can be used in a conventional, non-lifting mode. Furthermore, the lifting arm can be selectively held in a position corresponding to a fully depressed condition of the lifting arm so that again the seat can be used in a non-lifting mode.

12 Claims, 6 Drawing Sheets

LIFTING SEATS

DESCRIPTION

The present invention is concerned with lifting seats of the type employed in automatic spring-loaded seat chairs used principally by the elderly and infirm or rheumatic and arthritic sufferers Chairs of this type usually have a pivotable seat which is biased by one or more springs to a raised position in which the seat lies at an angle to the horizontal so that when a person sits on the seat the springs are compressed and the person is gently lowered to the normal sitting position in which the seat lies horizontally. When the person wishes to rise from the chair, he simply leans forward slightly and the springs act to pivot the seat and thereby assist the person to stand up. Such chairs are usually of the "cottage" type having relatively high seat and arms which again assist the user to get up from the seat.

Lifting seat chairs currently available are generally either of a type wherein the lifting mechanism for the seat is enclosed inside the upholstered lifting seat itself and therefore has to be tailored in advance to suit the weight and degree of disability of the prospective user, or of a type where several external tension springs are fitted to a linkage system. Chairs of the former type have the disadvantages of having the seat lying at approximately 45 degrees to the horizontal at all times when not in use and being unusable by anyone of less weight than the normal user. Chairs of the latter type accommodate for the weight variation between individuals by the removal or addition of springs in the linkage system. Such chairs suffer from the disadvantage that the alteration of the springs is time consuming and relatively awkward to accomplish. Again, the seat always adopts an angled, unsightly position when not in use.

It is also known for lifting chairs to incorporate a braking mechanism whereby the seat can be held in its actuated position with the springs in a compressed state whereby the seat is not at all times attempting to rise. A major problem with such known mechanisms is that the brake usually incorporates a toggle mechanism which can be operated irrespective of whether any one is sitting on the seat at the time and irrespective of the weight of that person. This can be very dangerous if, for example, a person of considerably less weight than the person for whom the chair was set up sits on that chair when in the "brake applied" condition. If that lighter person then releases the brake, he/she can be forcibly ejected from the seat as a result of the compression of the spring at a much more violent rate than normal, with possible consequential injury to that person.

It is a first object of the present invention to provide a lifting seat having an improved means for imparting adjustability to the seat.

It is another object of the invention to provide an improved means by which the seat need not permanently adopt an inclined condition when not in use whereby the seat can be used as a conventional non-lifting seat when desired.

In accordance with the present invention, there is provided a lifting seat device having a lifting arm coupled to or adapted to be coupled to a seat member and a mechanism for controlling the angular position of the lifting arm to assist in lowering and raising the seat member, the lowering and raising mechanism comprising at least one helical coil spring enclosed within a housing and whose stress is arranged to be increased upon the lifting arm being angularly displaced as a result of a user sitting on said seat member, there being means enabling the spring to be adjustably pre-stressed to enable the load/displacement characteristics of the lifting arm to be adjusted and preselected.

By allowing for the spring or springs to be pre-stressed, the apparatus is easily adjustable to accommodate any weight variation or degree of disability.

In some embodiments, the lifting arm is selectively separable from said mechanism so that, when the lifting arm is removed from or repositioned in said mechanism, the seat can be used in a conventional manner.

Preferably, the lowering and raising mechanism comprises an independent, underslung unit which includes said spring whose compression is arranged to be increased upon the lifting arm being angularly displaced as a result of a user sitting on said seat member, whereby upon the user leaning forward on the seat member the spring(s) urge the lifting arm back so as to assist the user in standing up from the seat.

Advantageously, in the case of a lifting seat chair, the unit which houses the lowering and raising mechanism is mounted to the chair frame so as to lie below the conventional resilient support means for the chair seat cushion, said mechanism including an entrance slot for receiving, via a space between the chair frame and said resilient support means, one end of the lifting arm.

Preferably, the other end of the lifting arm is connected to a seat support plate which is adapted to be attached to a seat cushion, or the like, on which the user is actually to sit. The connection between the lifting arm and the seat support plate may be rigid. Advantageously, however, the connection is pivoted so that the orientation of the seat support plate relative to the lifting arm can vary with the angular position of the lifting arm relative to said lowering and raising mechanism.

In one preferred embodiment of the invention, the lowering and raising mechanism comprises a spring loaded unit adapted to be located beneath the normal seat region of the chair, either as a fitting attached to an existing chair or fitted as original equipment during manufacture. The lifting arm can be a completely distinct item from the spring loaded unit and can be readily detachable from this unit merely by withdrawing it from a slot therein. With the lifting arm removed, the chair can then be used in a conventional manner whenever desired. The spring-loaded unit is situated beneath the existing seat of the chair, with sufficient clearance that it remains below the seat when the chair is used in a conventional manner. The latter embodiments thereby allow for the optional use of the lowering and raising facility by enabling the lifting arm to be selectively removable, leaving the chair to function and look normal when the lowering and raising facility is not required.

In some embodiments the lowering and raising mechanism can include a second slot positioned such that, when the lifting arm is inserted into it, the lifting arm adopts an inoperative, neutral position in which a seat cushion can be used in a conventional mode above it. In this case, the lifting arm need not be removed fully for conventional use of the chair but only repositioned from said entrance slot to said second slot.

In other embodiments, the lifting arm can be collapsible or retractible so that when it has been withdrawn from the entrance slot it can be folded flat against the underside of the seat support plate or can be collapsed into the material of the seat cushion, whereby to avoid the necessity for separating the lifting arm from the cushion before the cushion be replaced for use in a conventional mode.

In still other advantageous embodiments, there is provided a latch mechanism which enables the lifting arm to be firmly locked in its depressed position to enable the seat to be used in a conventional, non-lifting mode.

Preferably, the latch mechanism is such that it cannot be released (a) unless there is someone sitting on the seat and (b) that person is of at least the weight for which the prevailing press-stressed spring condition was intended. This can be achieved by the use of a locking plate which is held positively in a position preventing release of the lifting arm from its locked position until such a person is sitting on the seat and a release mechanism have been positively operated.

The invention is described further hereinafter, by way of example only, with reference to the accompanying drawings, in which.

Figure 6A:
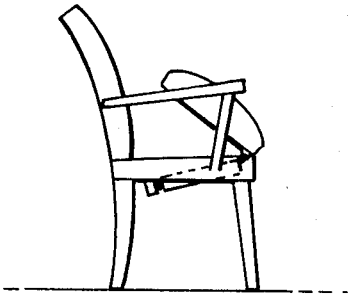
Figure 6B:
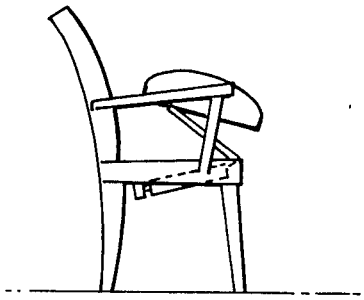
Figure 7:
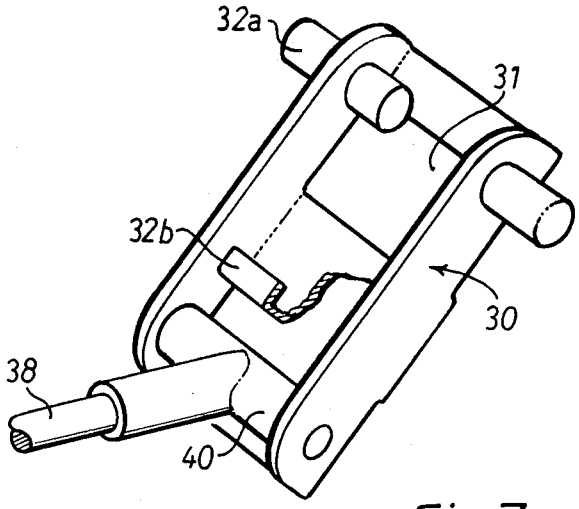
Figure 8:
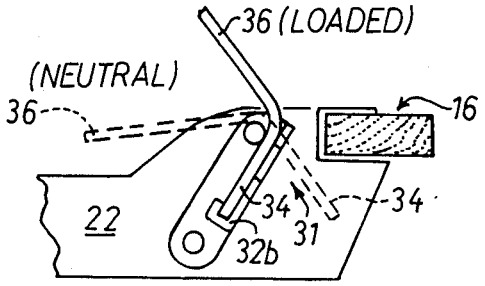
Figure 9:
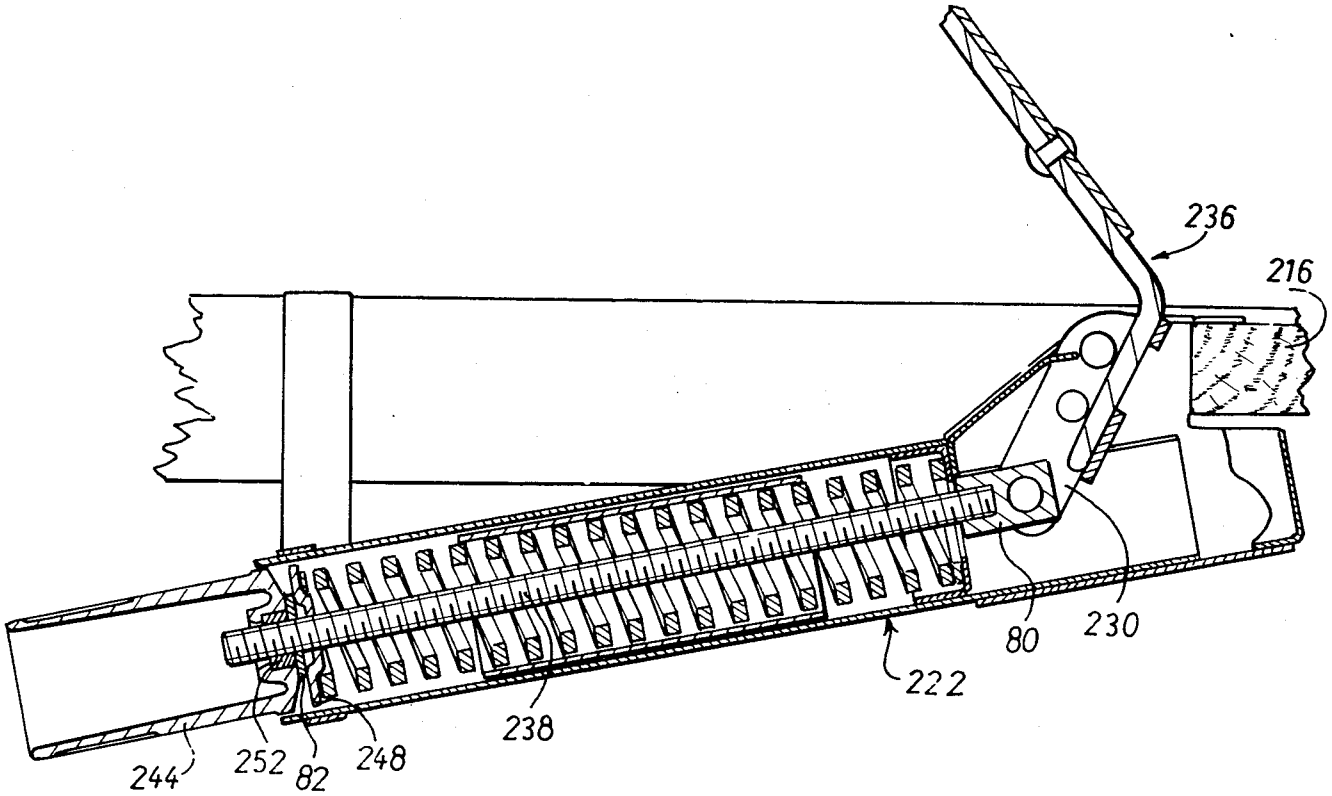
Figure 10:
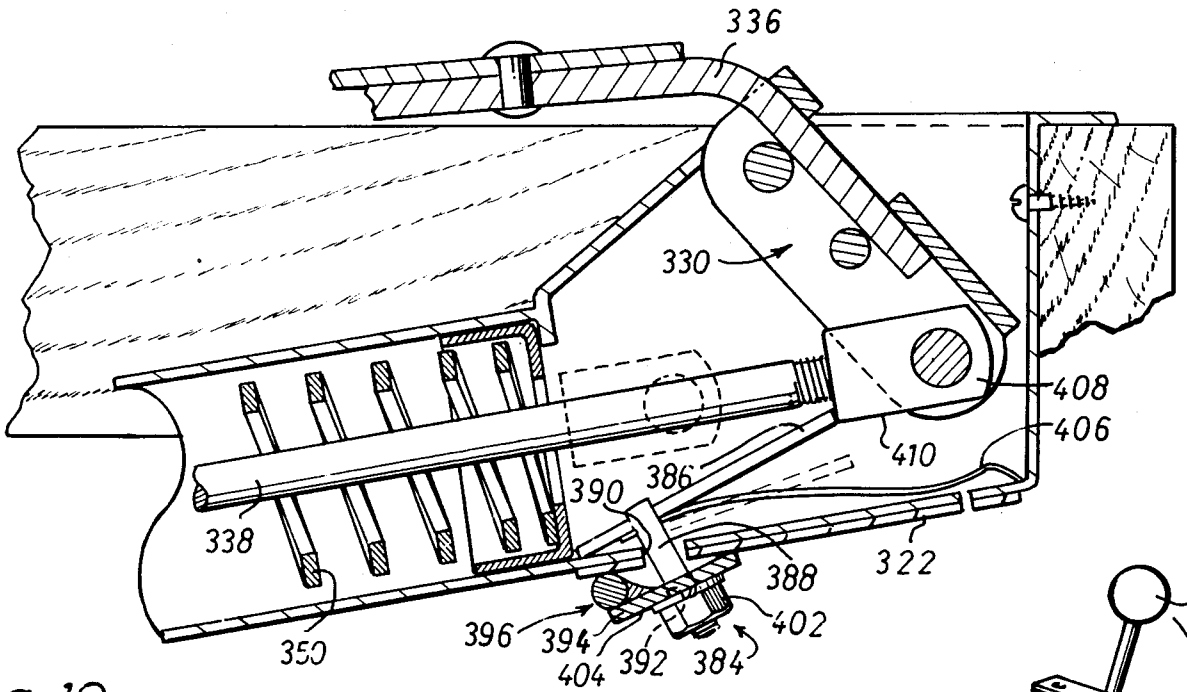
Figure 11:
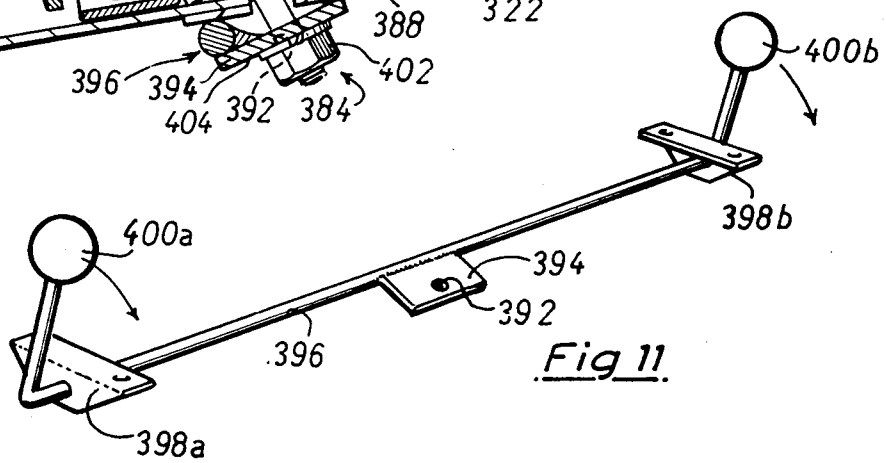
Figure 13A:
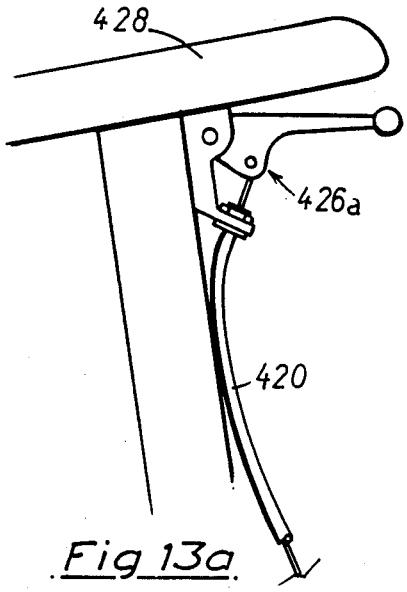
Figure 13B:
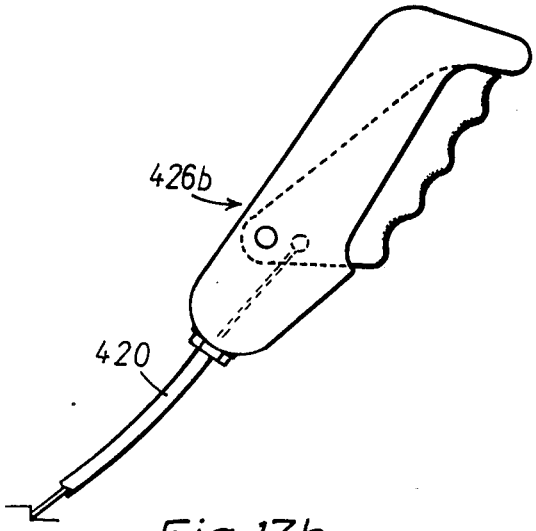
Figure 12:
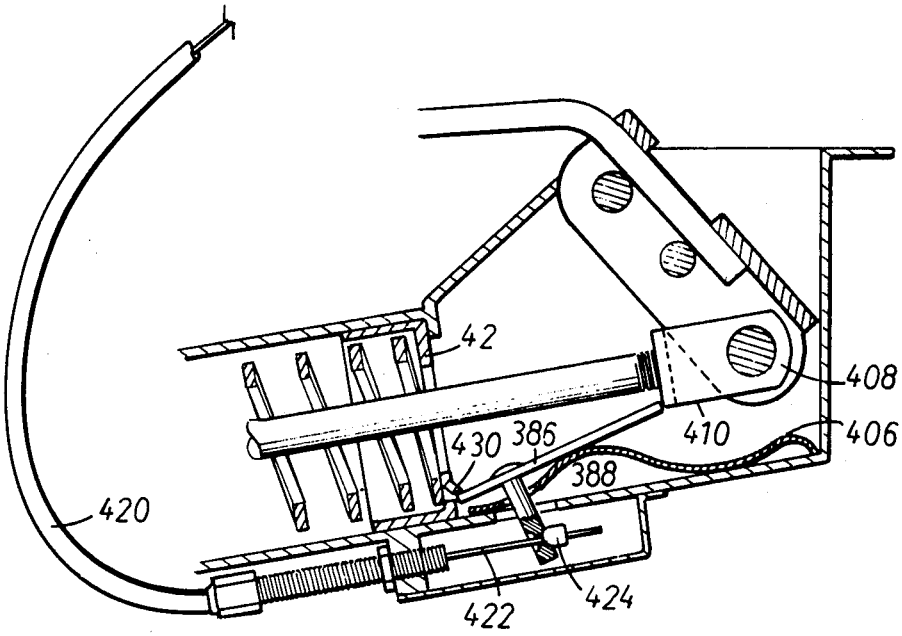

FIGS. 6*a* and 6*b* are diagrammatic side views of chairs fitted with first and second embodiments of lifting seat mechanisms in accordance with the present invention;

FIGS. 7 and 8 are diagrammatic perspective and sectional views of part of a further embodiment;

FIG. 9 is a sectional side view of a further embodiment in accordance with the present invention;

FIG. 10 is a sectional side view of part of a still further embodiment in accordance with the invention;

FIG. 11 is a perspective view of part of the embodiment of FIG. 10;

FIG. 12 is a sectional side view of a part of a still further embodiment employing a Bowden-type cable for releasing a latch mechanism; and FIGS. 13*a*, 13*b* show two possible embodiments of actuating devices for the latch mechanism.

FIGS. 1 to 5 show a first example of the present seat-lifting mechanism applied to a conventional armchair 10, the mechanism being disposed beneath the existing seat portion of the chair.

Figure 1:
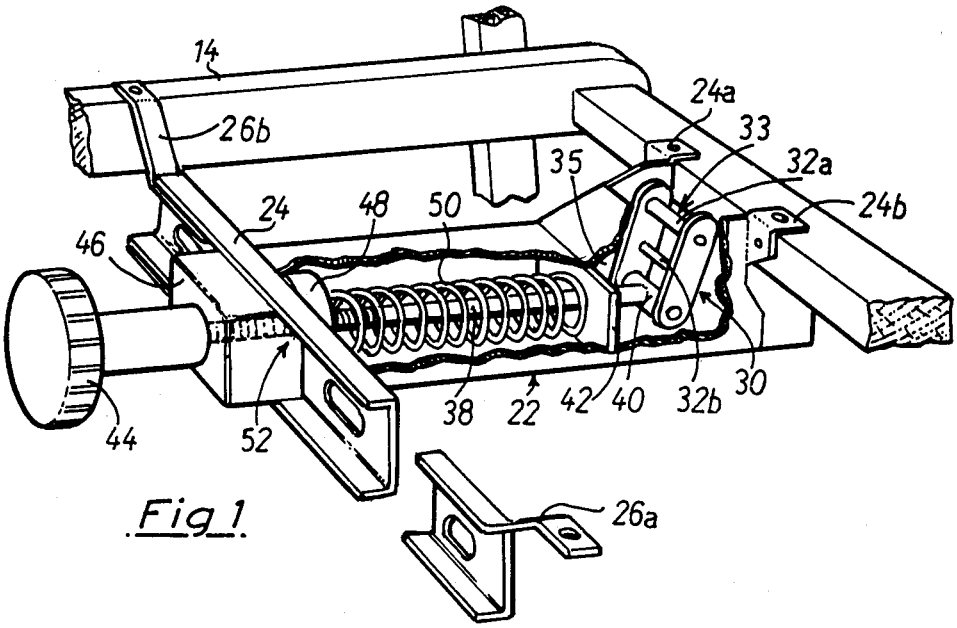
FIG. 1 is a diagrammatic, partially broken away, perspective view of part of one embodiment of a seat lifting mechanism in accordance with the present invention.
Figure 5:
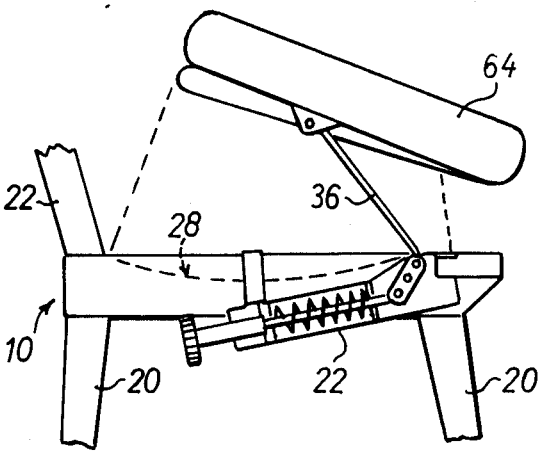
FIG. 5 is a diagrammatic, side view of part of a chair fitted with the mechanism of FIG. 1 and in one possible operated position.
Figure 4:
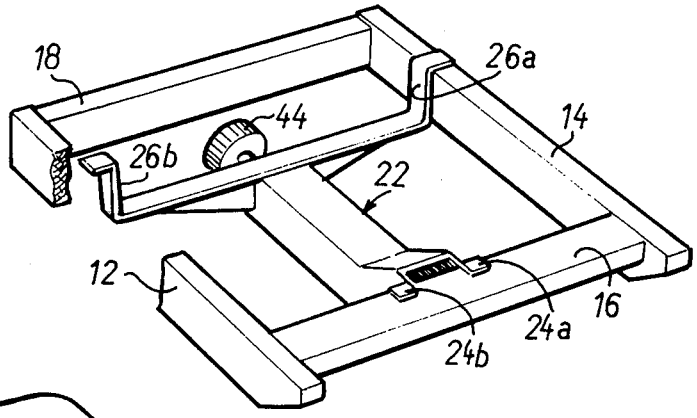
FIG. 4 is a diagrammatic perspective view illustrating how the mechanism may be fitted to a chair frame.

As indicated in FIGS. 1, 4 and 5, conventional chairs generally include a rectangular frame structure comprising a pair of parallel side beams 12, 14 which are interconnected by a front cross beam 16 and a rear cross beam 18. Although not shown in the drawings, there is provided between the beams 12 to 18 a means of resiliently supporting the seat cushion of the chair. Such means may comprise, for example, a plurality of discreet springs extending between two or more pairs of the beams 12 to 18 or, more usually these days, a continuous or substantially continuous web of material extended between the frame members 12 to 18, at least part of which is inherently elastic to provide the necessary resilient support for the seat cushion. Although not shown in the present drawings, it is assumed that one such cushion support means is present on the rectangular frame.

In a conventional manner, the rectangular frame also has legs 20 at its four corners, a chair back 22, and side arms (not shown in FIGS. 1 to 5).

As best seen in FIGS. 1 and 4, the lifting mechanism includes an elongate main body 22 which is adapted to be slung from the frame members 12 to 18 by means of a pair of lugs 24*a*, 24*b* at the front end of the main body 22, which are connected to the beam 16 of the frame by screws, and an extensible cross-bar 24 whose central portion is attached rigidly to the main body 22 and whose opposite ends are formed with lugs 26*a*, 26*b* which are screwed respectively to the side beams 12,14 of the frame. As best seen in FIG. 5, in this embodiment the suspension of the main body 22 is such that it lies at an angle to the horizontal. By virtue of this means of suspension, the main body 22 is arranged to lie below the lowest position occupied in use by the conventional resilient support for the seat cushion (indicated by the chain line 28 in FIGS. 3 and 5). It will be noted that the two ends of the cross-bar 24 are of adjustable length to enable the cross-bar to be fitted to chair frames having a wide variety of widths (see FIGS. 1 and 4).

Figure 3:
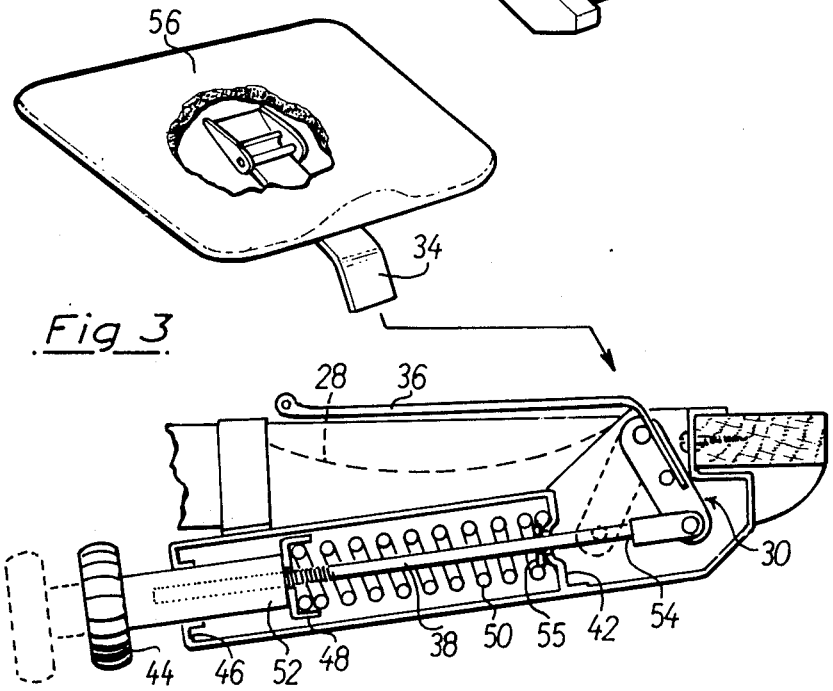
FIG. 3 is a diagrammatic sectional side elevation of part of the mechanism of FIG. 1.

Referring now principally to FIGS. 1 and 3, the main body 22 of the mechanism comprises a linkage member 30 of generally U-shaped section having a pair of parallel rods 32*a*, 32*b* extending between the side portions of the U so as to effectively define a slot 33 between said rods 32*a*, 32*b* and the base of the U for receiving a spigot 34 of a lifting arm 36 as described further hereinafter. The linkage member 30 forming the spigot receiver slot 33 is pivotally mounted on the rod 32*a* between a pair of parallel side plates 35 of the main body 22 and can swing freely between the positions illustrated in FIG. 1 in full and chain lines. The lower end of the pivoted linkage member 30 is pivotally coupled to one end of a rod 38 by way of a cross-head 40, the rod extending with lateral clearance rearwardly through a baffle plate 42 fixed rigidly to the body 22. The end of the rod remote from the pivoted member 30 is screw-threaded and receives an adjustable knob 44 which passes slidably through an end wall 46 of the main body 22. Disposed around the shank of the rod 38 between the baffle plate 42 and a stop washer 48 is a helical coil spring 50 which can be pre-tensioned by rotation of the knob 44 as described below to suit the weight of a person who is to use the seat. The knob need not itself be screw-threaded but can carry a nut 52 at its one end which engages the screw-thread of the rod 38. A stop 54 on the rod 38 limits the extent of clockwise pivoting of the member 30, as viewed in FIG. 3. Anti-clockwise rotation of the member 30 is limited by a stop 55 on the rod 38.

Figure 2:
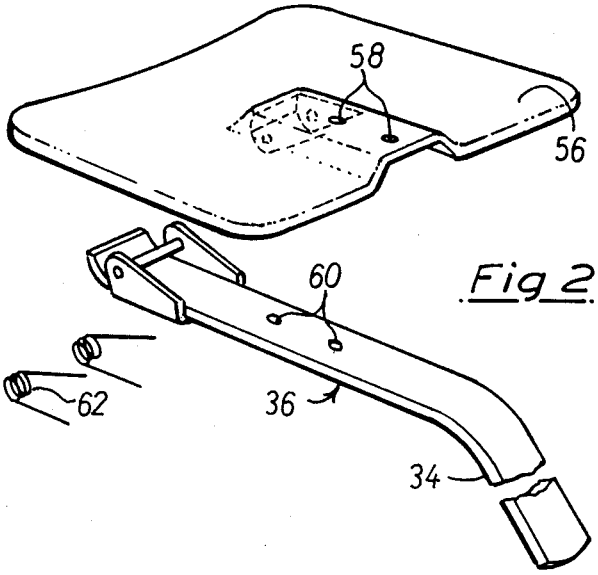
FIG. 2 is an exploded perspective view of a seat supporting portion of the first embodiment.

With reference to FIGS. 2 and 3, the mechanism also includes the lifting arm 36 having the spigot 34 extending obliquely from its one end. In the illustrated embodiment, the lifting arm 36 is formed from a rectangular-sectioned steel bar which is bent intermediate its length to form the spigot 34. The lifting arm 36 is adapted to carry a thin-section seat support plate 56. In one embodiment, the seat support plate is attached to the lifting arm 36 by means of screws which pass through aligned holes 58, 60 in the seat support plate and the arm 36. In other (preferred) embodiments, the end of the lifting arm 36 remote from the spigot 34 is pivotally attached to a central region of the seat support plate 56 as indicated in FIG. 2 so that the seat support plate is capable of limited pivotal movement relative to the arm 36. In the latter case, the interconnection of the seat support plate and the lifting arm can optionally include one or more torsion springs 62 which bias the support plate 56 in an anti-clockwise direction as viewed in FIG. 2 for a purpose described further below.

In use, with the main body 22 in position in the frame of the chair as illustrated in FIGS. 1 and 4, the spigot 34 is inserted, via the usual space between the springs of the seat support (not shown) or the elastic supporting web, and the frame, into the slot 33 disposed adjacent the front beam 16 of the chair frame. The spring 50 biases the linkage member 30 into its position shown in full lines in FIG. 1 (chain lines in FIG. 3) whereby the lifting arm 36 extends above the chair frame at an angle of about 45° to the horizontal (see FIG. 5). The seat support plate 56 is adapted to be slipped into a pocket formed on the underside of a seat cushion 64 so that the cushion 64 lies above the seat plate 56 and adopts any angular orientation taken up by that plate 56. By virtue of the spring-loaded pivotal interconnection between the lifting arm 36 and the seat plate 56, the plate 56 (and hence the seat cushion) assume an orientation as shown in FIG. 5 in which the cushion lies at an angle of approximately 20° to the horizontal and at the order of 30° to 40° to the arm 36. When a person then sits on the inclined cushion 64, he or she is gently lowered by the spring-loaded lifting arm 36 until the cushion reaches a final, substantially horizontal position wherein the arm 36 is sandwiched between the cushion and the resilient support means, such as the aforementioned springs or elastic web. In pivoting to this position, the arm 36 causes corresponding pivoting of the linkage member 30 to the chain line position of FIG. 1 (solid line position of FIG. 3) whereby the rod 38 is moved to the right as viewed in FIG. 3 and the spring 50 is further compressed between the baffle plate 42 and the stop washer 48, taking the weight of the user. The knob is pre-adjusted so as to pre-tension the spring 50 such that the weight of a given user is sufficient to bring about the above-described condition wherein the seat takes up a horizontal position but with the whole weight of the user borne by the spring 50.

When the sitter then wishes to rise, he or she merely leans forward on the seat cushion and the lifting arm 36 rises according to the predetermined force set by the position of the knob 44, thereby assisting the sitter to rise from the chair. The spring 50 is chosen to accommodate within its range of adjustment all likely weights of individuals who will wish to use the chair. It will be appreciated that the knob 44 is easily accessible at the rear of the underslung mechanism for adjusting the pre-tension of the spring 50.

A variation in the height of the cushion in its starting position, illustrated in FIG. 5, can be obtained simply by selecting a spigot arm 34 (see FIG. 2) of different length. In this case, limit stops within the mechanism come into operation to limit the possible travel of the rod 38. Further cushions can be sandwiched between the underside of the arm 36 and the seat supporting means if desired.

In the event that the seat support plate 56 is fixed rigidly to the lifting arm 36 the seat cushion in its initial position prior to use adopts a position as shown in FIG. 6*a* wherein the front edge of the cushion still lies closely adjacent the front beam 16 of the chair frame. However, in the event that the arm 36 is pivotally attached to the seat support plate, the cushion takes up an initial position as illustrated in FIG. 6*b* wherein the cushion lies above and well clear of the beam 16. In the latter embodiment, the arm is pivotally attached to a location on the seat support plate which corresponds substantially to the centre of the seat cushion and the seat plate 56 and lies at an angle approximately 30° to 40° to the arm. When the sitter sits on the cushion, the seat plate 56 then progressively changes its angle with the arm 36 until the angle is substantially zero when the seat plate reaches its final position. It will be noted in this connection that conventional lifting seats provide the same basic lifting action as in FIG. 6*a* wherein the lift available is limited - any further increase in the angle beyond 45° merely results in a forward push rather than a lifting action.

It will also be noted that when the seat support plate 56 is attached pivotally to the lifting arm 36, the cushion supported on the plate 56 is able to keep the sitter in a vertical position during the lowering and lifting action of the mechanism. This allows for an increase in the angle of lift of the arm, enabling a lifting seat facility to be fitted to lower chairs than would hitherto have been considered feasible.

In this embodiment, it will be appreciated that, when the lifting seat facility is not required, the arm 36 is simply lifted so as to withdraw the spigot from the slot 33. The seat support plate can then be removed from the pocket on the underside of the seat cushion and the cushion can be replaced so that the chair then operates entirely conventionally with the cushion supported on the resilient cushion support springs, the elastic web or the like. To use the chair once more in the seat lifting mode, these steps are simply reversed again.

It will also be appreciated that the present mechanism can be factory fitted to new chairs or can be fitted simply to existing chairs merely by screwing the body 22 to the chair frame in the manner described above.

The present seat lifting mechanism is not restricted to use in chairs and it has many other applications such as in toilets, invalid chairs and the like where assistance is required occasionally by certain individuals but where conventional use by others would be useful.

In the application of the present mechanism to a toilet seat, a main body 12, similar to the main body 22 of FIGS. 1 to 5, is mounted in front of the toilet bowl so that the seat lifting arm, to which a toilet seat is attached, normally adopts an angle of about 45° to the horizontal, but lies horizontally over the bowl aperture when supporting the weight of a user. In this embodiment the spigot and the lifting arm will be substantially colinear.

Advantageously, the main body is carried by a supporting frame (which may be wheeled) which can be moved to a position adjacent the toilet so that the toilet seat lies over the toilet bowl. The mechanism can then be removed from the vicinity of the toilet when not needed and a conventional toilet seat can be applied. If required, the seat support plate can again be attached pivotally to the seat (i.e. the toilet seat in this case) so that a greater lifting height can be achieved.

Although the illustrated mechanisms use only a single spring 50, in other embodiments several such springs may be used, either in series or in parallel in order to obtain the required spring characteristics.

FIG. 9 shows a further embodiment which is essentially the same as that of FIGS. 1 to 5 in operating principle but incorporates detailed engineering differences. The principal difference is that instead of the box-like housing 22 of the first embodiment, the embodiment of FIG. 9 uses a tubular housing 222. A threaded rod 238 extends through the tubular housing, one end being pivotally connected to the lower end of the linkage member 230 via a block 80 and the other end carrying a nut 252 mounted within a hollow tubular adjusting knob member 244. Mounted around the rod 238 is a helical coil spring 250, one end of which engages against a stop at the right-hand end of the tubular body 222 and the other end of which is engaged by a dished washer 248. Between the dished washer 248 and the end surface of the knob member 244 there is disposed a thick washer 82. Disposed around part of the spring 250 is a sleeve to prevent the spring rubbing on the inside of the tubular body 222. The extent of precompression of the spring is selected by rotation of the knob 244. The operation of this embodiment is exactly the same as that of the embodiment of FIGS. 1 to 5.

In the embodiments described so far, the lifting arm must be detached from the seat cushion or other seat members before that member can be replaced for conventional use. This is not necessary, however, and in other embodiments the lifting arm can be arranged to be accommodated within or adjacent the cushion or seat member without interferring with these members when used in the conventional mode. For example, the spigot may be angularly collapsible in the manner of a hinge so that although it is effectively rigid in the angular direction, it can be folded in the opposite direction so as to lie flat against or to lie within the seat cushion or other seat member. In other embodiments, the spigot could be telescopic so as to be retractable into the seat cushion when not required. In such cases, it is preferable for the seat support member to be incorporated integrally within the seat cushion.

In still further embodiments, the linkage member 30 is formed with an aperture or slot 31 in the base portion of the U (see FIGS. 7 and 8). As shown by the chain line in FIG. 8, when the lifting seat function is not required and the seat is to be used in a conventional mode, it is merely necessary to withdraw the spigot from the slot 33 and to insert it into the aperture 31, whereby the arm 36 then lies generally below the horizontal and does not interfere with the conventional use of a cushion on top of it. Such cushion can be separate from the seat support 56 or integral with it as described above. This arrangement is particularly convenient as no component has to be removed for conventional use of the chair and no modification or adjustment of the arm 36 or spigot 34 is necessary, other than a change of position.

FIGS. 10 and 11 show a still further embodiment in which it is not essential to detail the lifting arm to enable conventional use of the chair. The embodiment of FIGS. 10 and 11 has the additional advantage of incorporating a latching mechanism for holding the lifting arm firmly in the depressed condition when required.

The basic structure of the embodiment of FIGS.10 and 11 is the same as that of the embodiment of FIG. 9, and indeed of FIGS. 1 to 5. The principal difference lies in the provision of a latch mechanism 384 comprising a flat metal latch plate 386 which is mounted rigidly on a reduced diameter end portion of a metal pin 388. The pin 388 extends with clearance through an aperture 390 in the base of the housing 322 and also with clearance through an aperture 392 in a catch release member 394 which is welded along one edge to an elongate bar 396. The bar 396 is mounted rotatably in brackets **398*a*,398*b* which are screwed rigidly to the underside of the wooden side members 12,14 of the chair frame (see FIG. 4). The two ends of the bar are bent at right-angles to form knobbed levers 400*a*,400*b* disposed on the two sides of the chair, respectively. The lowerend of the pin 388 carries a nylok nut 402 and a washer 404 beneath the latch plate 394. Mounted between the underside of the latch plate 386 and the shoulder on the pin 388 is one end of a flexible leaf spring 406, the other end of which abuts hard against the inner wall of the housing 322 at the bottom corner thereof, as shown in FIG. 10**.

The effect of the spring 406 is such that the latch plate is biassed both upwardly and to the left as viewed in FIG. 10 so that, in combination with the constraint imposed by the presence of the bar 396, it is forced to adopt an inclined attitude in relation to the longitudinal axis of the rod 338. As shown in FIG. 10, the rod 338 is pivotally coupled to the linkage member 330 by way of a brass block 408 having a flat underside surface 410. When the seat is in its lifted position, it will be appreciated that the brass block 408 lies to the left of the position it occupies in FIG. 10. In this condition, the right-hand end of the latch plate 386 either engages the underside surface 410 of the block 408 or lies to the right of it, with the right-hand bottom edge of the block 408 riding on the top side surface of the plate 386. When then a person sits on the seat so that the lifting arm 336 pivots anti-clockwise and moves the brass blocks to the right, the right-hand edge of the latch plate runs along the underside of the brass block until, when the lifting arm 336 has substantially reached its maximum depression condition, the latch arm engages behind the left-hand edge of the brass block. It will be noted that the upward biasing effect of the spring 406 is such that the latch member will not return from this position on its own, but can only be so displaced by positive rotation of one or both of the levers **400*a*,400*b*. Normally, the spring 350 is adjusted by the knob 344 (not shown in FIG. 10) so that when the weight of the sitter is being fully supported by the spring 350**, the end of the latch plate lies slightly to the left of the left-hand edge of the brass block.

If, then, the sitter decides he/she wishes to get up with spring assistance, it is only necessary to rotate the levers 400 sufficiently to lower the end of the latch plate clear of the brass block, at the same time as leaning slightly forward in the chair. The end of the latch plate can then slide along the underside of the brass block again during the raising movement provided by the mechanism. On the other hand, should it be required for the seat to be used in a conventional, non-lifting mode, once the latch plate is locked behind the brass block it cannot be released until a person of the necessary set weight sits on the chair and operates the levers 400. While the chair is not in use, or is in use by a person of lesser weight, the end of the latch plate is held firmly against the end of the brass block, this condition being assisted by the latch plate having an oblique end edge surface which lies substantially vertically in the latch portion of FIG. 10 so as to lie parallel to the surface of the brass block against which it is in engagement.

Thus, this seat can be selectably fixed in a position in which the lifting bar 336 lies generally horizontally so that the seat can be used in a conventional mode.

In some cases, it is advantageous for the chair to have no conventional supporting webbing or springs at all. In this case, additional resilient support for the seat can be achieved by the provision of a pair of rubber buffers on the upper surface of the cross-bar 24, on either side of the centre line of the chair. Advantageously, these buffers are of frusto-conical configuration to provide a variable spring rate when compressed by the seat. They may also have longitudinal blind bores to increase their resiliency. When such buffers are provided, it is advantageous to reduce the length of the lugs 26*a*,26*b* (FIG. 4) since it is not necessary for the body to be so angled relative to the chair frame, there being no webbing or springs present relative to which clearance has normally to be provided.

In the latter embodiment where the conventional webbing or springs is removed or dispensed with, the additional advantage is obtained that the adjusting knob 244 is readily visible, its adjusted position is readily apparent, and it lies in an easily accessible position. The adjustment position of the knob is rendered more readily visible by having colour coded sections which are selectively exposed.

In a further modification of the embodiment of FIGS. 10 and 11, it is preferred for there to be provided a means of retaining the levers 400 in their actuated position so as to free the user's hands to assist in standing up from the seat. For example, the latter means can comprise a further rigid projection on the rod 396 which is adapted to slidingly engage a bowed leaf spring fitted to the underside of the chair frame whereby to hold the rod 399 in its actuated position, in which the latch is released to enable the seat to be lifted by the main spring 350, when it has been rotated by the user by actuation of the levers 400. The latter leaf spring can then hold the rod 396 in this position until it is moved back by the user returning the levers 400 to the position of FIG. 10, when sitting on the seat.

A more preferred means of operating the latch mechanism is shown in FIGS. 12, 13*a* and 13*b*. Parts corresponding to those shown in FIGS. 10 and 11 are given the same reference numerals, In this embodiment, the bar 396 and catch release mechanism 394 are replaced by Bowden-cable 420 whose inner wire 422 is coupled to the free end of the pin 388 by means of a soldered ferrule 424. The other end of the cable 420 carries an actuating lever 426 which can, for example, be adapted to fit beneath the arm 428 of a chair as shown in FIG. 13*a* (426*a*) or can be a free, hand-held device as shown in FIG. 13*b* (426*b*). The latter embodiment is particularly suitable for use when the chair is fully upholstered.

This embodiment works in the same manner as that of FIGS. 10 and 11 except that release of the latch is achieved more conveniently. It will be noted that, since the plate 394 is no longer present, it is necessary to provide a protrusion 430 on the rear face of the abutment plate 42 in order to prevent the left-hand edge of the latch plate from lifting.

I claim:

1. A lifting seat device for mounting to a structure having a support and a seat member movable from said support, said lifting seat device comprising:

(a) a lifting arm for coupling to the seat member; and (b) a lowering and raising mechanism for controlling the angular position of the lifting arm to assist in lowering and raising the seat member, the lowering and raising mechanism comprising:

(1) a housing having opposed first and second ends and comprising a stop at the first end, said stop comprising an aperture extending therethrough;

(2) mounting means carried by the housing for enabling the housing to be mounted rigidly to the structure;

(3) a rod extending through the aperture in the stop and into the housing;

(4) at least one helical coil spring disposed within the housing and surrounding a portion of the rod disposed in the housing, said spring comprising an end disposed adjacent the stop of the housing;

(5) an adjusting member adjustably coupled to the rod and mounted generally adjacent the second end of said housing such that said spring is compressed intermediate said adjusting member and the stop of said housing with the compression of said spring being determined by the adjustable position of said adjusting member relative to said rod; and (6) linkage means for coupling the helical coil spring to the lifting arm such that the stress in the helical coil spring is increased when the lifting arm is angularly displaced as a result of a user sitting on said seat member, said linkage means comprising a linkage member which is pivotable relative to said housing, said linkage member comprising engaging means for receiving one end of said lifting arm, said linkage member being pivotally connected to the end of said rod opposite said adjusting member, whereby angular displacement of the lifting arm caused by a user sitting on the seat member causes an angular displacement of said linkage member relative to said housing and a corresponding axial displacement of the rod relative to the stop to increase the compression of the spring.

2. A lifting seat device according to claim 1, wherein the support comprises a chair having a frame and a resilient support means attached thereto for supporting a seat cushion, the mounting means of the lifting seat device comprising means for mounting to the chair frame so as lie below said resilient support means for the chair seat cushion in the position normally occupied thereby.

3. A lifting seat device according to claim 2, wherein one end of the lifting arm is connected to a seat support plate which is selectively attachable to a seat cushion means, on which the user is actually to sit.

4. A lifting seat device according to claim 3, wherein the connection between the lifting arm and the seat support plate is rigid.

5. A lifting seat device according to claim 3, wherein the connection between the lifting arm and the seat support plate is pivotable so that the orientation of the seat support plate relative to the lifting arm can vary with the angular position of the lifting arm relative to said lowering and raising mechanism.

6. A lifting seat device according to claim 1 wherein said lowering and raising mechanism includes a second engaging means for engaging the lifting arm and positioned such that, when the lifting arm is engaged by it, the lifting arm adopts an inoperative, neutral position in which a seat cushion can be used in a conventional mode above the lifting arm, whereby the lifting arm need not be removed fully for conventional use of a chair but only repositioned from said engaging means to said second engaging means.

7. A lifting seat device having:

(a) a lifting arm for coupling to a seat member; and (b) a mechanism for controlling the angular position of the lifting arm to assist in lowering and raising the seat member, the lowering and raising mechanism comprising:
(1) a housing,
(2) means carried by the housing for enabling the housing to be mounted rigidly to the frame of a seat;
(3) at least one helical coil spring disposed within the housing;
(4) an elongate rod extending axially through the helical coil spring;
(5) one end of the helical coil spring engaging a first, fixed annular stop on the housing, and the other end of the helical coil spring being engaged by a second annular stop mounted adjustably on one end of said rod whereby the pre-compression in the helical spring between said first and second stops is controlled by the position of said second annular stop on the rod, and
(6) a pivotable linkage member coupled to the other end of said rod and adapted to receive said lifting arm, whereby angular displacement of the linkage member by the lifting arm in a direction corresponding to a user sitting on the seat results in axial displacement of the rod relative to said first fixed stop such as to increase the compression of the spring.

8. A lifting seat device for mounting to a seat having a frame and a seat member, said lifting seat device comprising:
(a) a lifting arm for coupling to the seat member; and
(b) a lowering and raising mechanism for controlling the angular position of the lifting arm to assist in lowering and raising the seat member, the lowering and raising mechanism comprising:
(1) a generally tubular housing having opposed first and second ends;
(2) mounting means carried by the housing for enabling the housing to be rigidly mounted to the frame of a seat, said mounting means comprising a first bracket means mounted to the first end of the generally tubular housing for attaching the first end of the housing to the chair frame, an elongate cross-bar mounted generally adjacent the second end of said tubular housing and extending perpendicular thereto said cross-bar comprising bracket means on the opposed ends thereof for attaching the second end of the generally tubular housing to the chair frame;
(3) at least one helical coil spring disposed generally coaxially within the generally tubular housing;
(4) pivotable linkage means for coupling the helical coil spring to the lifting arm such that the linkage means pivots when the lifting arm is angularly displaced as a result of a user sitting on said seat member with such pivoting of the linkage means increasing stress in the helical coil spring;
(5) means enabling the helical coil spring means to be adjustably pre-stressed to enable the load/displacement characteristic of the lifting arm to be adjusted and pre-selected; and
(6) a latch mechanism mounted in proximity to said generally tubular housing and pivotal relative thereto from a first position which permits free pivotal movement of said linkage means to a second position in which said latch mechanism lockingly retains said linkage means in a position corresponding to a fully compressed condition of the helical spring, to enable the seat to be used selectively in a conventional, non-lifting mode.

9. A lifting seat device for mounting to a frame having a seat member movable from said frame, said device comprising:
(a) a lifting arm for coupling to a seat member;
(b) a lowering and raising mechanism for controlling the angular position of the lifting arm to assist in lowering and raising the seat member, the lowering and raising mechanism comprising:
(1) a generally tubular housing;
(2) mounting means carried by the generally tubular housing for enabling the housing to be mounted rigidly to the frame;
(3) at least one helical coil spring disposed within the generally tubular housing;
(4) an elongate rod extending axially through the helical coil spring;
(5) one end of the helical coil spring engaging a first, fixed stop on the housing, and the other end of the helical coil spring being engaged by a second stop mounted adjustably on one end of said rod whereby the pre-compression in the helical spring between said first and second stops is controlled by the adjustable position of said second stop on the rod;
(6) a pivotable linkage member pivotally coupled to the other end of said rod and pivotal relative to said housing, said linkage member being mounted to said lifting arm, such that angular displacement of the linkage member by the lifting arm in a direction corresponding to a user sitting on the seat results in pivotal movement of said linkage member relative to said housing and axial displacement of the rod relative to said first fixed stop such as to increase compression of the spring; and
(7) a latch mechanism having means selectively moveable into position for locking the lifting arm in its depressed position, corresponding to a substantially fully compressed condition of the helical spring, to enable the seat to be used selectively in a conventional, non-lifting mode.

10. A lifting seat device according to claim 9, wherein said latch mechanism comprises a latch plate which is selectively pivotable between a first position in which it permits free pivotal movement of said linkage member and a second position in which it holds said linkage member in a condition corresponding to a substantially fully depressed state of the lifting arm.

11. A lifting seat device according to claim 10, wherein said latch plate is coupled rigidly to a lever means which can be pivoted manually by a user of the seat for effecting displacement of the latch plate between said two positions.

12. A lifting seat device according to claim 10, wherein the latch plate is coupled to one end of a Bowden-type cable whose other end carries a hand-grip actuator enabling the user of the seat to pivot the latch plate selectively between said two positions.

* * * * *